US008499528B2

(12) United States Patent
Grandich

(10) Patent No.: US 8,499,528 B2
(45) Date of Patent: Aug. 6, 2013

(54) BALUSTRADE HAVING METAL BALUSTERS WITH ORNAMENTAL ENDS

(75) Inventor: Eric J. Grandich, Houston, TX (US)

(73) Assignee: RTG Concepts LLC, Houston, TX (US)

( * ) Notice: Subject to any disclaimer, the term of this patent is extended or adjusted under 35 U.S.C. 154(b) by 42 days.

(21) Appl. No.: 12/554,815

(22) Filed: Sep. 4, 2009

(65) Prior Publication Data

US 2009/0321702 A1 Dec. 31, 2009

Related U.S. Application Data

(63) Continuation of application No. 11/536,267, filed on Sep. 28, 2006, now abandoned.

(51) Int. Cl.
*E04F 11/18* (2006.01)

(52) U.S. Cl.
USPC ..... 52/832; 52/184; 52/848

(58) Field of Classification Search
USPC ..... 52/726.2, 720.1, 690, 182, 183, 184, 52/185, 186, 187, 188, 189, 190, 191, 832, 52/833, 848, 849; 256/67, 59
See application file for complete search history.

(56) References Cited

U.S. PATENT DOCUMENTS

| | | | | |
|---|---|---|---|---|
| D4,194 | S | 6/1870 | MacFerran | |
| 310,807 | A | 1/1885 | Ferer | |
| D37,730 | S | 12/1905 | Wheelock | |
| 1,797,883 | A | 3/1931 | Strubel | |
| D174,373 | S | 4/1955 | Bell | |
| 4,386,761 | A * | 6/1983 | Kato | 256/21 |
| D274,366 | S | 6/1984 | Porter et al. | |
| 5,441,241 | A | 8/1995 | McKim | |
| 5,676,013 | A | 10/1997 | Kahlau | |
| 5,876,021 | A | 3/1999 | Spence et al. | |
| 6,059,269 | A | 5/2000 | Ross | |
| 6,240,698 | B1 | 6/2001 | Chung | |
| 6,260,829 | B1 | 7/2001 | Anderson et al. | |
| 6,305,670 | B1 | 10/2001 | Ward et al. | |
| 6,311,957 | B1 | 11/2001 | Driscoll et al. | |
| 6,807,788 | B1 | 10/2004 | Terry | |
| 7,044,448 | B1 | 5/2006 | Jones | |
| 7,082,735 | B2 | 8/2006 | Ramsey | |
| D610,716 | S | 2/2010 | Edwards | |
| 2005/0205855 | A1 | 9/2005 | Chung | |

* cited by examiner

*Primary Examiner* — Michael Safavi
(74) *Attorney, Agent, or Firm* — Gordon G. Waggett, P.C.

(57) ABSTRACT

A metal baluster is provided which has first and second metal segments, where each of these metal segments comprises a first end and a second end. The first ends of the first metal segments include extension portions from mating engagement with one another and the second end of each metal segment is adapted for attachment to the underside of an elongated handrail or to a tread or floor. The second end of each of the metal segments further comprises an ornamental portion which is proximate the elongated handrail or the tread or the floor. Connection apparatuses provided for securing the engagement of the extension portions of the first metal segment and the second metal segment. In another embodiment, a metal baluster of the present invention may comprise three metal segments where the first two metal segments are adapted for attachment to the underside of an elongated rail or to tread or floor and has an ornamental portion proximate the first end. These first and second metal segments are joined together by a third metal segment which has two ends which are adapted from mating engagement with the second ends of the first and second segments. A balustrade is also provided which comprises a plurality of balusters as described above.

11 Claims, 4 Drawing Sheets

BALUSTRADE HAVING METAL BALUSTERS WITH ORNAMENTAL ENDS

CROSS-REFERENCE TO RELATED APPLICATION

The present application is a continuation application of application Ser. No. 11/536,267 filed Sep. 28, 2006.

BACKGROUND OF THE INVENTION

1. Field of the Invention

The present invention relates to balusters which may be used to form balustrades such as for guardrails or handrails on staircases, balconies and the like. More particularly, the present invention relates to metal balusters which have an ornamental portion proximate the ends that are adapted to connect to a handrail or to a floor or tread.

2. Description of the Prior Art

Stairway and balcony railings are available in a myriad of designs and types have been developed for both residential and commercial stairways, balconies and walkways requiring or desiring protective or ornamental railings. Balustrades are often formed of a number of balusters that extend vertically to support a handrail on a staircase or balcony.

Within the last few years a shift has occurred away from using wooden balusters to using metal balusters in residential stairways and balconies. Metal balusters typically are produced by well-known welding, forging, casting or other techniques to form a single, solid metal baluster. These balusters have been marketed as either raw metal coated with primer or rust inhibitor or finished with a final coat such as a clear coat, powder coat or paint.

Metal balusters have commonly been available in predetermined lengths, e.g., 44 inches. It is necessary for proper installation of these metal balusters to adjust the length of each baluster by cutting off one or both ends to meet differing regional code specifications with respect to balusters. Because it is necessary to remove one or both ends of each baluster to make a proper length adjustment, the ornamental or decorative designs on the balusters have been limited to the center portion of the baluster and away from any area that may be removed, i.e., the ends of the baluster.

Currently, the only option available to have metal balusters with decorative ends is to have each baluster custom fabricated to the desired length and design prior to installation. Such fabrication involves the purchase of raw metal and then fabricating the metal into the desired lengths and designs followed by the application of a finish coat. This procedure is costly and not seen as a cost-effective solution to many homeowners and builders. Custom fabrication railing systems are also very time consuming and difficult to complete due to the fact that some fabrication and finishing must usually be done at the installation location.

The industry has long sought a railing system that has an expensive custom fabricated and finished appearance, the ease of installation a traditional decorative baluster, and a cost which is a fraction of the expense of custom fabricated railings. This novel and useful result has been achieved by the present invention.

SUMMARY OF THE INVENTION

In accordance with the present invention, a metal baluster is provided which comprises first and second metal segments. Each of these metal segments comprises a first end and a second end. The first end of the first metal segment includes an extension portion for mating engagement with the first end of the other metal segment, and the second end of each metal segment is adapted for attachment to the underside of an elongated handrail or tread or floor. The second end of each of the metal segments further comprises an ornamental portion which is proximate the elongated handrail and proximate the tread or the floor.

A metal baluster according to the present invention further comprises connection apparatus for securing the engagement of the extension portion of the first metal segment to the second metal segment. In one embodiment, the connection apparatus is a knuckle which encases the engagement of the extension portion of the first metal segment and the second metal segment and which is adhesively bonded to that engagement.

In one embodiment of the present invention, the first end of one of the metal segments is hollow and the first end of the second metal segment is adapted to receive the hollow end of the first metal segment. In yet another embodiment of the present invention, the first end of one of the metal segments is solid and the first end of the second metal segment is adapted to receive the first end of the first metal segment.

Another embodiment a metal baluster according to the present invention may comprise three metal segments. The first and second metal segments have a first end which is adapted for attachment to the underside of an elongated rail, or to a tread or floor and comprises an ornamental portion proximate the first end. The third metal segment has two ends which are adapted for mating engagement with the second ends of the first and second metal segments, and connection devices as described above are provided for securing these engagements.

In accordance with the present invention, a balustrade is also provided which comprises a plurality of balusters as described above.

DESCRIPTION OF SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention practiced without those details and that numerous variations from and modifications of the described embodiments may be possible. The following description is thus intended to illustrate and not to limit the present invention.

Figure 1:
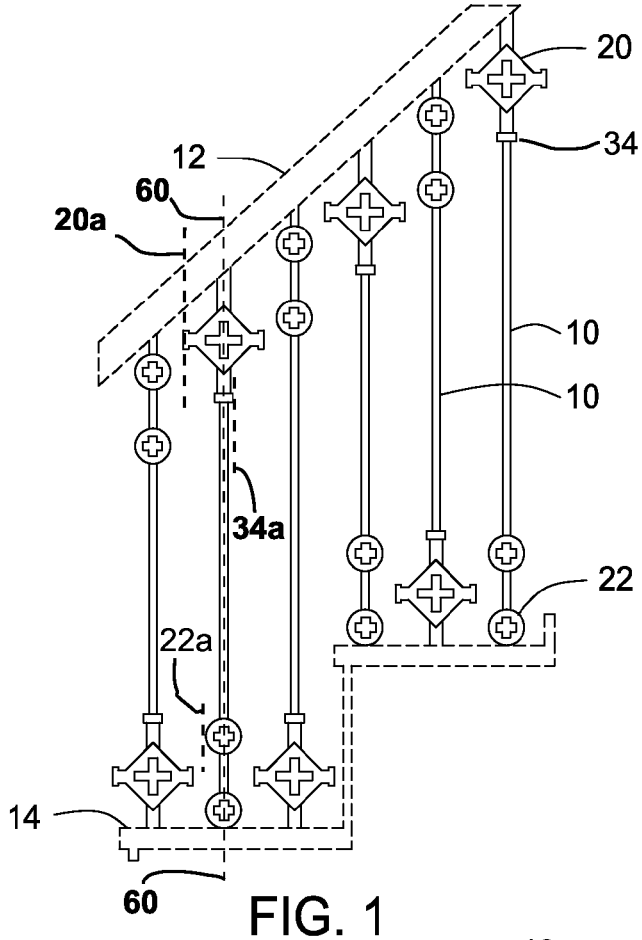
FIG. 1 is an elevation view illustrating a balustrade for a staircase comprising a plurality of metal balusters in accordance with the present invention.
Figure 2:
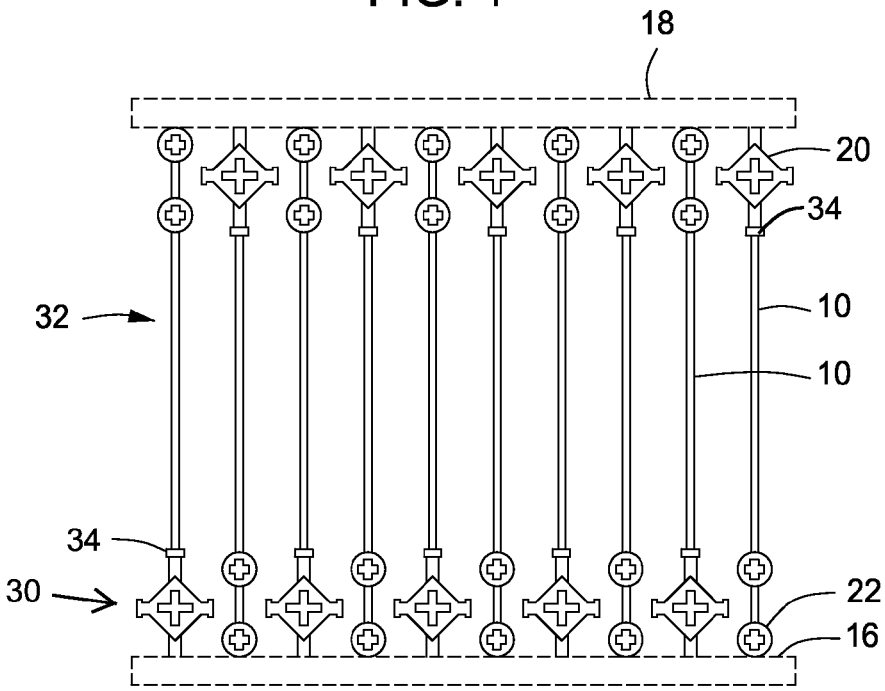
FIG. 2 is an elevation view of a balustrade for a balcony comprising a plurality of metal balusters in accordance with the present invention.

With reference first to FIG. 1, a plurality of balusters 10 in accordance with the present invention are illustrated installed about a respective axis 60 between elongated handrail 12 and the tread 14 of a staircase. Each baluster 10 is fabricated from a suitable metal material and comprises ornamental portions 20 and 22 proximate its respective ends. The ends of each baluster 10 are adapted for attachment to the underside of elongated handrail 12 and to tread 14 of a staircase, or alternatively as illustrated in FIG. 2, the ends of baluster 10 may be attached to the underside of elongated handrail 18 and to a floor 16. Ornamental portions 20 and 22 also comprise respective outermost surfaces 20*a* and 22*a* located at respective radial distances from the axis 60.

Figure 3A:
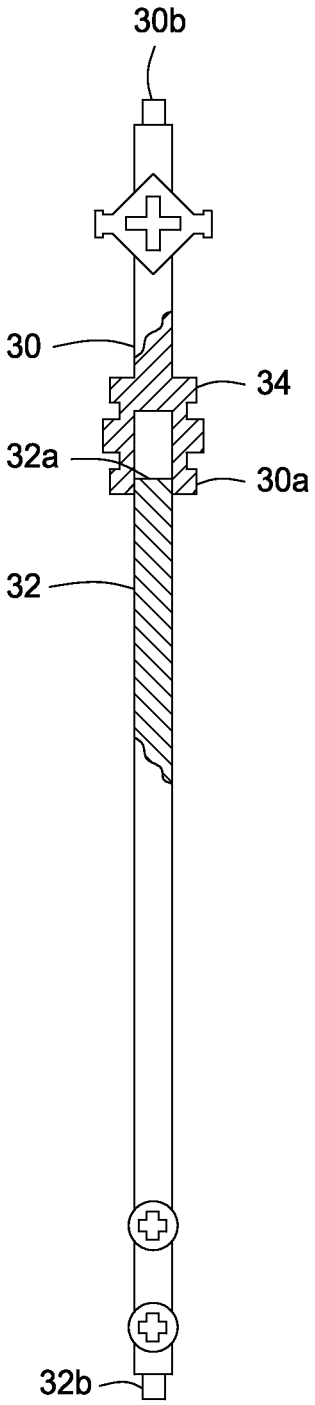
FIGS. 3A and 3B are elevation views in partial cross-section which illustrate connection apparatus for joining the ends of metal segments of a baluster in accordance with the present invention.
Figure 3B:
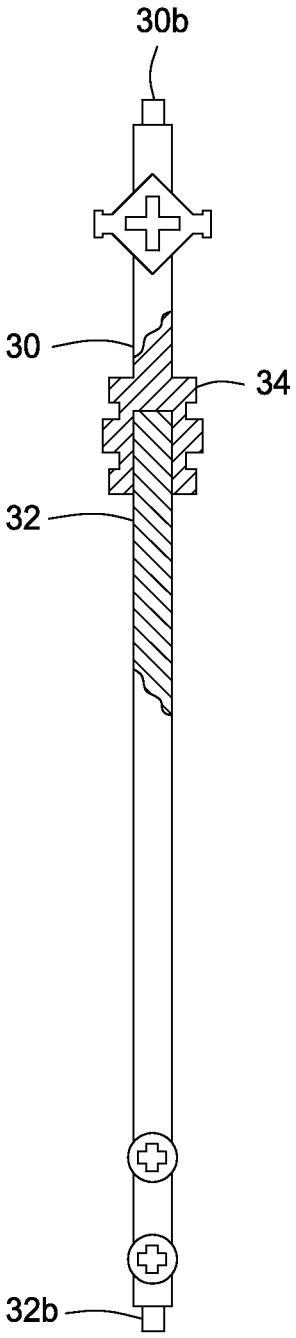

With reference now to FIGS. 3A and 3B, each metal baluster 10 comprises two metal segments 30 and 32. Metal segment 30 has first and second ends 30*a* and 30*b*, and metal segment 32 has first and second ends 32*a* and 32*b*. The second ends 30*b* and 32*b* of the two metal segments 30 and 32 are adapted for attachment to the underside of the elongate handrail or to tread or floor as illustrated in FIGS. 1 and 2. Such attachment may, for example, be effected by the insertion on ends 30*b* and 32*b* in holes formed in the underside of the handrail 12 and in the tread 14 or floor 16.

The first end 32*a* of metal segment 32 comprises an extension portion for mating engagement with the first end 30*a* of metal segment 30. The distance between the underside of the handrail and the tread or floor may vary from locale to locale or from installation to installation within the same locale. Accordingly, the length of the extension portion of the first end of metal segment 32 may be shortened to provide balusters of different lengths. This shortening takes place in the middle portion of the baluster—not at the end of the baluster. Thus a metal baluster according to the present invention provides ornamental portions 20 and 22 proximate the underside of the handrail and near the tread or floor.

A metal baluster in accordance with the present invention also comprises connection apparatus 34 for securing the engagement of the extension portion of the first metal segment 32 and first end 30*a* of the second metal segment 30. As illustrated in FIGS. 3A and 3B, this connection apparatus may comprise a knuckle 34 which is attached proximate the first end 30*a* of metal segment 30 and which encases the engagement of the extension portion at the first end 32*a* of the first metal segment 32 with the first end 30*a* of the second metal segment 30. These two end portions may be adhesively bonded together, for example, by utilizing epoxy. A set screw may advantageously be employed to secure the two pieces in place while the adhesive bonding material sets. Connection apparatus 34 also comprises an outermost surface 34*a* located at a radial distance from the axis 60 that is less than the radial distance between ornamental portion 20 outermost surface 20*a* and axis 60.

With reference still to FIGS. 3A and 3B, the first end 32*a* of metal segment 32 may have a central axial portion which is hollow and which may engage an axial protrusion in the hollow portion of end 30*a* of metal segment 30.

Figure 4:
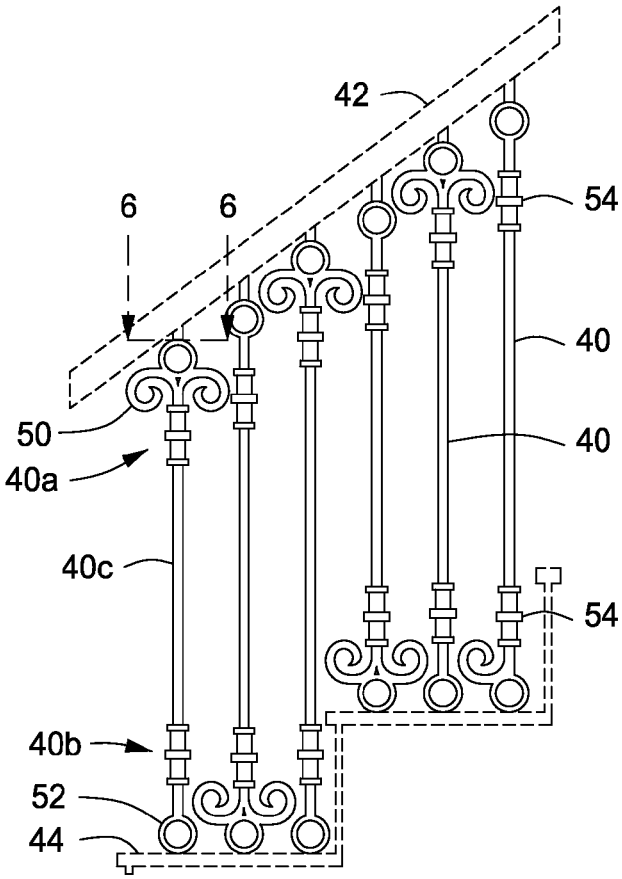
FIG. 4 is an elevation view illustrating a balustrade for a staircase comprising a plurality of metal balusters in accordance with the present invention.
Figure 5:
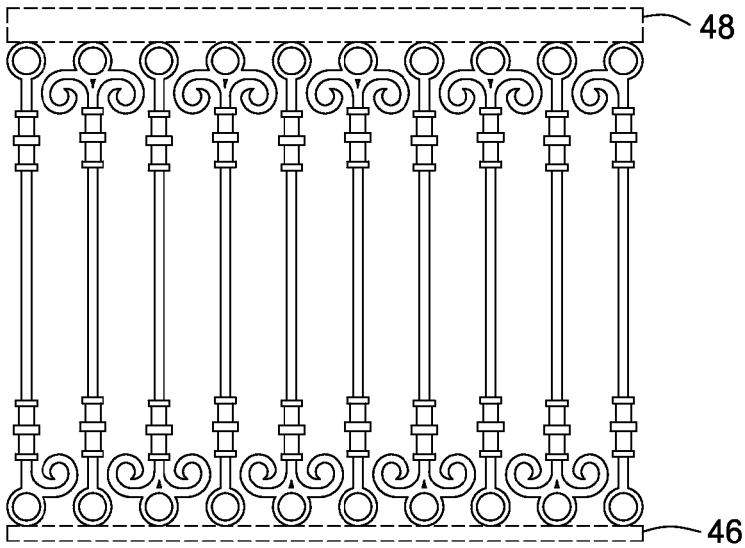
FIG. 5 is an elevation view of a balustrade for a balcony comprising a plurality of metal balusters in accordance with the present invention.
Figure 6:
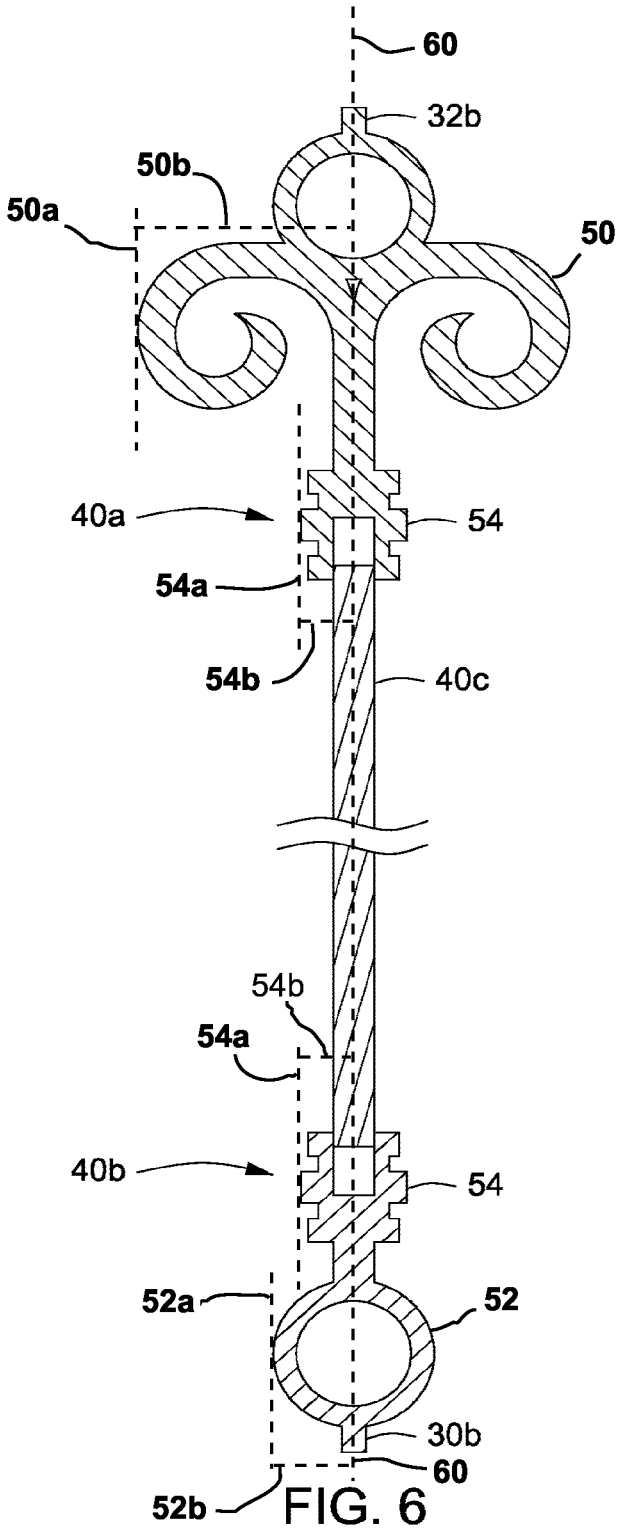
FIG. 6 is an elevation view in cross-section taken along the line 6-6 of FIG. 4.

With reference now to FIG. 4, there is illustrated an alternative embodiment of a baluster 40 in accordance with the present invention. Each metal baluster 40 comprises three metal sections 40*a*, 40*b* and 40*c*. The first and second metal segments 40*a* and 40*b* each have first and second ends where the first end is adapted for attachment to the underside of an elongated rail 42 or tread 44 as illustrated in FIG. 4 or adapted for attachment to the underside of an elongated rail 48 and to a floor 46 as illustrated in FIG. 5. The first ends of metal segments 40*a* and 40*b* comprise an ornamental portion 50 and 52, respectively. The second ends of metal segments 40*a* and 40*b* are hollow as illustrated in FIG. 6. As illustrated in FIG. 6, ornamental portions 50 and 52 also comprise respective outermost surfaces 50*a* and 52*a* located at respective radial distances 50*b* and 52*b* from the axis 60.

A third metal segment 40*c* is provided and is adapted for mating engagement between the second ends of the first and second metal segments. In one embodiment, the first and second ends of the third of metal segment 40*c* are adapted to be received in the hollow ends of the first and second metal segments 40*a* and 40*b*, as illustrated in FIG. 6. Connection devices 54 comprise the connection devices 34 as illustrated in FIGS. 3A and 3B and may advantageously be used for securing the ends of the third metal segment 40*c* to the second ends of the first and second metal segments 40*a* and 40*b*. Connection apparatus 54 also comprises an outermost surface 54*a* located at a radial distance 54*b* from the axis 60 that is less than the radial distances 52*b*, 54*b* between respective ornamental portions 50, 52 outermost surfaces 50*a*, 52*a* and axis 60.

Utilization of a baluster in accordance with the present invention results in a balustrade that has an expensive custom fabricated and finished appearance, the ease of installation of a traditional decorative balustrade, and a cost which is a fraction of the expense of a custom fabricated metal balustrade.

What is claimed is:

1. A balustrade, comprising a plurality of balusters attached between the underside of an elongated rail and a tread or a floor, wherein each of said plurality of balusters comprises:

a middle metal segment having opposed ends;

a first metal segment comprising a first ornamental portion positioned along a first metal segment axis between a first connection member and a second connection member opposite the first connection member, wherein the first connection member is adaptable for attachment to the underside of an elongated rail, to a tread or to a floor, and wherein the first connection member comprises an outermost surface located at a first radial distance from the first axis, wherein the second connection member comprises a hollow section to receive one of the opposed ends of the middle metal segment, and wherein the second connection member further comprises an outermost surface located at a second radial distance from the first axis, wherein the first ornamental portion comprises a first desired ornamental design, the outermost edges of the first ornamental design extending to a third radial distance from the first axis, and wherein the third radial distance is greater than the second radial distance; and a second metal segment comprising a second ornamental portion positioned along a second metal segment axis between a first connection member and a second connection member opposite the first connection member, wherein the first connection member is adaptable for attachment to the underside of an elongated rail, to a tread or to a floor, and wherein the first connection member comprises an outermost surface located at a first radial distance from the second axis, wherein the second connection member comprises a hollow section to receive one of the opposed ends of the middle metal segment, and wherein the second connection member further comprises an outermost surface located at a second radial distance from the second axis, wherein the second ornamental portion comprises a second desired ornamental design, the outermost edges of the second ornamental design extending to a third radial distance from the second axis, and wherein the third radial distance is greater than the second radial distance.

2. The balustrade of claim 1 wherein the first connection member of the first metal segment of each baluster, and the first connection member of the second metal segment of each baluster, comprise male connection ends that are insertable into holes formed in the underside of the elongated rail, in the tread or in the floor.

3. The balustrade of claim 1 wherein the first ornamental design of one of the plurality of balusters is different than the second ornamental design of said baluster.

4. The metal baluster of claim 1 wherein the first ornamental design of one of the plurality of balusters is the same as the second ornamental design of said baluster.

5. The balustrade of claim 1 wherein the ornamental designs on one of the plurality of balusters is different than the ornamental designs on another of the plurality of balusters.

6. A metal baluster comprising:

a middle metal segment having opposed ends;

a first metal segment comprising a first ornamental portion positioned along a first metal segment axis between a first connection member and a second connection member opposite the first connection member, wherein the first connection member is adaptable for attachment to the underside of an elongated rail, to a tread or to a floor, and wherein the first connection member comprises an outermost surface located at a first radial distance from the first axis, wherein the second connection member comprises a hollow section to receive one of the opposed ends of the middle metal segment, and wherein the second connection member further comprises an outermost surface located at a second radial distance from the first axis, wherein the first ornamental portion comprises a first desired ornamental design, the outermost edges of the first ornamental design extending to a third radial distance from the first axis, and wherein the third radial distance is greater than the second radial distance; and a second metal segment comprising a second ornamental portion positioned along a second metal segment axis between a first connection member and a second connection member opposite the first connection member, wherein the first connection member is adaptable for attachment to the underside of an elongated rail, to a tread or to a floor, and wherein the first connection member comprises an outermost surface located at a first radial distance from the second axis, wherein the second connection member comprises a hollow section to receive one of the opposed ends of the middle metal segment, and wherein the second connection member further comprises an outermost surface located at a second radial distance from the second axis, wherein the second ornamental portion comprises a second desired ornamental design, the outermost edges of the second ornamental design extending to a third radial distance from the second axis, and wherein the third radial distance is greater than the second radial distance.

7. The metal baluster of claim 6 wherein the first connection member of the first metal segment, and the first connection member of the second metal segment comprise male connection ends that are insertable into holes formed in the underside of the elongated rail, in the tread or in the floor.

8. The metal baluster of claim 6 wherein the first ornamental design is different than the second ornamental design.

9. The metal baluster of claim 6 wherein the first ornamental design is the same as the second ornamental design.

10. A metal baluster, comprising:

a middle metal segment having opposed ends;

a first metal segment comprising a first ornamental portion positioned between a first connection member and a second connection member opposite the first connection member, the first connection member comprising a first male member permanently attached to, and extending outward from, the first ornamental portion, the first male member being insertable into a female receiving member located in the underside of an elongated rail, in a tread or in a floor, the second connection member being adaptable for attachment to one end of the middle segment; and a second metal segment comprising a second ornamental portion positioned between a first connection member and a second connection member opposite the first connection member, the first connection member comprising a second male member permanently attached to, and extending outward from, the second ornamental portion, the second male member being insertable into a female receiving member located in the underside of an elongated rail, in a tread or in a floor, the second connection member being adaptable for attachment to the other end of the middle segment;

wherein the second connection members of the first and second metal segments are hollow and wherein the opposed ends of the middle metal segment are adapted to be received in the hollow ends of the first and second metal segments, respectively.

11. A balustrade, comprising a plurality of balusters attached between the underside of an elongated rail and a tread or a floor, wherein each of said plurality of balusters comprises:

a middle metal segment having opposed ends;

a first metal segment comprising a first ornamental portion positioned between a first connection member and a second connection member opposite the first connection member, the first connection member comprising a first male member permanently attached to, and extending outward from, the first ornamental portion, the first male member being insertable into a female receiving member located in the underside of an elongated rail, in a tread or in a floor, the second connection member being adaptable for attachment to one end of the middle segment; and a second metal segment comprising a second ornamental portion positioned between a first connection member and a second connection member opposite the first connection member, the first connection member comprising a second male member permanently attached to, and extending outward from, the second ornamental portion, the second male member being insertable into a female receiving member located in the underside of an elongated rail, in a tread or in a floor, the second connection member being adaptable for attachment to the other end of the middle segment;

wherein the second connection members of the first and second metal segments of each of said plurality of balusters are hollow and wherein the opposed ends of the middle metal segment of each of said plurality of balusters are adapted to be received in the hollow ends of the first and second metal segments, respectively.

* * * * *